US007806404B2

(12) United States Patent
deJong et al.

(10) Patent No.: US 7,806,404 B2
(45) Date of Patent: Oct. 5, 2010

(54) SKEW ADJUSTMENT OF PRINT SHEETS BY LOADING FORCE ADJUSTMENT OF IDLER WHEEL

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 303 days.

(21) Appl. No.: 11/937,916

(22) Filed: Nov. 9, 2007

(65) Prior Publication Data

US 2009/0121419 A1 May 14, 2009

(51) Int. Cl.
*B65H 7/02* (2006.01)

(52) U.S. Cl. ..... 271/228

(58) Field of Classification Search ..... 271/228
See application file for complete search history.

(56) References Cited

U.S. PATENT DOCUMENTS

| | | | | |
|---|---|---|---|---|
| 4,971,304 | A | 11/1990 | Lofthus | |
| 5,094,442 | A | 3/1992 | Kamprath et al. | |
| 5,169,140 | A | 12/1992 | Wenthe, Jr. | |
| 5,219,159 | A | 6/1993 | Malachowski et al. | |
| 5,278,624 | A | 1/1994 | Kamprath et al. | |
| 5,313,253 | A * | 5/1994 | Martin et al. | 271/256 |
| 5,697,608 | A | 12/1997 | Castelli et al. | |
| 5,887,996 | A | 3/1999 | Castelli et al. | |
| 6,137,989 | A | 10/2000 | Quesnel | |
| 6,168,153 | B1 * | 1/2001 | Richards et al. | 271/228 |
| 6,173,952 | B1 * | 1/2001 | Richards et al. | 271/228 |
| 6,374,075 | B1 * | 4/2002 | Benedict et al. | 399/395 |
| 6,533,268 | B2 | 3/2003 | Williams et al. | |
| 7,243,917 | B2 | 7/2007 | Knierim et al. | |
| 7,527,263 | B2 * | 5/2009 | DeGruchy et al. | 271/228 |
| 2003/0146567 | A1 | 8/2003 | Williams et al. | |

OTHER PUBLICATIONS

Karns, Kara L., An Empirical Evaluation of Nip Mechanics as it Impacts Paper Drive Variability in a Copy Registration System, Xerox Internal Report Data Sheet, Accession No. X9500117, Issued May 9, 1995.

* cited by examiner

*Primary Examiner*—Gene Crawford
*Assistant Examiner*—Gerald W McClain
(74) *Attorney, Agent, or Firm*—Pepper Hamilton LLP

(57) ABSTRACT

Systems and methods for reducing sheet skew in a document processing device are disclosed. A document processing device may include a plurality of nips, a sheet skew measurement system, a feedback controller and an actuator. Each nip may include an idler wheel and a drive wheel. The sheet skew measurement system may be configured to measure sheet skew for a sheet. The feedback controller may be configured to generate a control signal in response to the sheet skew measured by the sheet skew measurement system. The actuator may be configured to adjust a loading force applied to a sheet by an idler wheel for at least one nip in response to the control signal.

10 Claims, 6 Drawing Sheets

SKEW ADJUSTMENT OF PRINT SHEETS BY LOADING FORCE ADJUSTMENT OF IDLER WHEEL

BACKGROUND

The present disclosure generally relates to document processing devices and methods for operating such devices. More specifically, the present disclosure relates to methods and systems of adjusting the skew of print sheets in a document processing devices.

Sheet registration is performed in document processing devices that require a medium (i.e., the sheet) to be properly positioned and aligned at a known location. A sheet registration system may align and position a sheet in such document processing devices.

FIG. 1A depicts a top view of a portion of an exemplary document processing device known in the art. As shown in FIG. 1A, the document processing device 100 includes three pairs of nips 105*a-b*, 110*a-b*, and 115*a-b*. Transport nips 105*a-b* are used to transport a sheet to a sheet registration system 120; registration nips 110*a-b* are used to perform sheet registration; and auxiliary sheet transport nips 115*a-b* are typically used to move the sheet in the process direction after registration. Although two nips are shown for each nip location, additional or fewer nips may be used. In some cases, additional nips may be used to account for variations in sheet size during the transport or registration processes.

Document processing devices, such as 100, typically have auxiliary sheet transport nips 115*a-b* between a sheet registration system 120 and a location 125 where sheets need to be registered. The sheet registration system 120 seeks to deliver a sheet to the auxiliary sheet transport nips 115*a-b* with no more than a certain amount of skew error. However, the auxiliary sheet transport nips 115*a-b* can introduce additional skew error before the sheet reaches the registration location 125 due to errors and disturbances, such as sheet drag force variation, nip alignment, nip force and other similar factors. In addition, auxiliary sheet transport nips 115*a-h* are typically driven by a single motor and are not currently used to register a sheet.

The document processing device 100 also includes a plurality of sensors, such as 130*a-c*, which are used to determine the position and alignment of the sheet prior to, during or after registration. Alternately, encoders can be placed on the nips to assist with sheet registration. Methods and systems using sensors and/or encoders to assist with sheet registration are known to those of ordinary skill in the art.

When using a conventional document processing device, a sheet arrives from an upstream device, such as a feeder, a duplex path or the like. Each set of nips 105*a-b*, 110*a-b*, and 115*a-b* includes, for example, two nips (one on the inboard side and one on the outboard side) that propel the sheet substantially in a process direction. As shown in FIG. 1B, a typical nip, such as 115*a*, includes a drive wheel, such as 150, and an idler wheel, such as 155. The composition and operation of a drive wheel and an idler wheel are described below.

A normal force caused by loading the idler wheel and friction with the sheet can be used to produce a forward force that propels the sheet. As a result, a lead edge, trail edge or other reference point within the sheet is delivered to the registration location 125 with specified registration performance. In other words, the sheet registration system 120 delivers each sheet at a specified lateral position (x-direction) and angular orientation (skew) at a specified time and with a specified velocity. Other exemplary sheet registration systems are disclosed in U.S. Pat. Nos. 5,697,608 to Williams et al. and 5,094,442 to Kamprath et al.

The sheet registration system 120 passes a sheet to a set of auxiliary sheet transport nips 115*a-b* that are located between the sheet registration system and the registration location 125. Auxiliary sheet transport nips 115*a-b* are typically driven by a single motor, which causes the angular velocity of the inboard and outboard nips to be substantially identical. If a variable speed or servo motor is selected, the process direction (x-direction) registration can be finely controlled. However, the use of a single motor precludes fine adjustment in skew in such sheet registration systems. Using separate motors for each auxiliary sheet transport nip 115*a-b* allows fine skew adjustment to be performed, but at the cost of an additional motor, which can be prohibitive. Moreover, it can be difficult to retrofit a single motor auxiliary nip system to a dual motor configuration.

SUMMARY

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "nip" is a reference to one or more nips and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention. As used herein, the term "comprising" means "including, but not limited to."

In an embodiment, a document processing device may include a plurality of nips each including an idler wheel and a drive wheel, a sheet skew measurement system configured to measure sheet skew for a sheet, a feedback controller configured to generate a control signal in response to sheet skew measured by the sheet skew measurement system, and an actuator configured to adjust a loading force applied to a sheet by an idler wheel for at least one nip in response to the control signal.

In an embodiment, a method of reducing sheet skew may include receiving a sheet by a document processing device including a first nip and a second nip each including an idler wheel configured to apply a loading force against the sheet as the sheet moves through the corresponding nip and a drive wheel, measuring a sheet skew for the sheet, generating a control signal in response to the measured sheet skew, and adjusting a first loading force for the idler wheel of the first nip based on the control signal.

In an embodiment, a system for reducing sheet skew may include a processor, a processor readable storage medium in communication with the processor, a sheet skew measurement system in communication with the processor, a first nip comprising a first idler wheel and a first drive wheel, a second nip comprising a second idler wheel and a second drive wheel, and an actuator in communication with the processor. The first idler wheel may be configured to apply a first loading force against a sheet as the sheet moves through the first nip. The actuator may be configured to adjust the first loading force. The processor readable storage medium may contain one or more programming instructions for performing a method of reducing sheet skew. The method may include receiving, by the processor, information from the sheet skew measurement system, determining, by the processor, a sheet skew based on the information, and transmitting, by the processor, a control signal to the actuator based on the determined sheet skew. The control signal may cause the actuator to adjust the first loading force.

BRIEF DESCRIPTION OF THE DRAWINGS

Aspects, features, benefits and advantages of the present invention will be apparent with regard to the following description and accompanying drawings, of which.

DETAILED DESCRIPTION

Figure 1A:
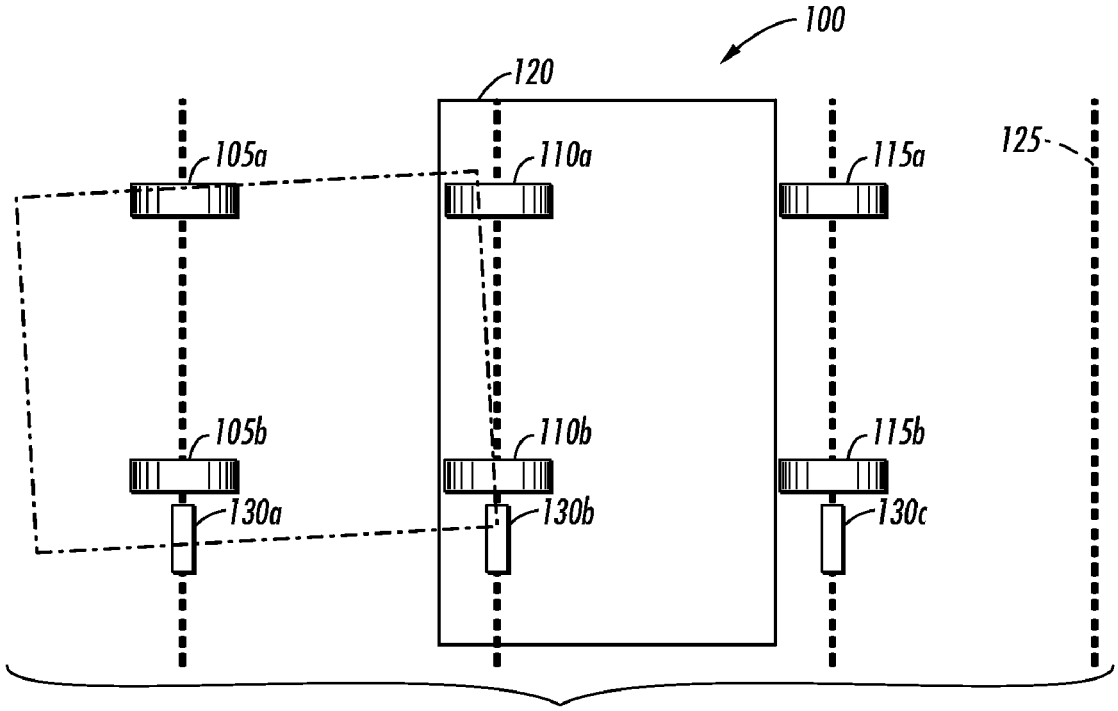
FIG. 1A (PRIOR ART)
FIG. 1A depicts a top view of a portion of a document processing device.
Figure 1B:
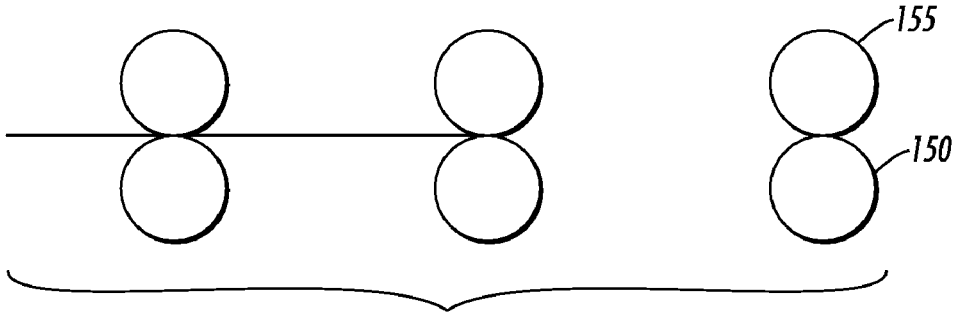
FIG. 1B (PRIOR ART)
FIG. 1B depicts a side view of a portion of a document processing device.

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "nip" is a location in a document processing device at which a force is applied to a sheet to propel the sheet in a process direction. A nip may include, for example and without limitation, a drive wheel and an idler wheel.

A "drive wheel" is a nip component that is designed to propel a sheet in contact with the nip. A drive wheel may comprise a compliant material, such as rubber, neoprene or the like. A drive wheel may be directly driven via a stepper motor, a DC motor or the like, Alternately, a drive wheel may be driven using a gear train, belt transmission or the like.

An "idler wheel" is a nip component that is loaded against the drive wheel. The loading of an idler wheel produces a normal force that together with friction between the wheels of the nip and a sheet produces a forward force that propels the sheet in the process direction. An idler wheel may comprise a non-compliant material.

An "actuator" is a mechanical or electromechanical device used to move or control a mechanism or system. A processor or other controller may control the actuator by providing one or more control signals.

The disclosed embodiments relate to devices and methods that enable fine skew registration control in an auxiliary set of nips that is cost effective and can be easily retrofitted in existing systems. While the embodiments disclosed herein pertain to methods and systems in which auxiliary sheet transport nips perform sheet skew adjustment operations alternate and/or additional nips may be modified according to the teachings described herein, and such embodiments are included within the scope of this disclosure.

An exemplary single motor driven auxiliary sheet transport nip system is disclosed herein. Typically, an inboard nip and an outboard nip are spaced apart in a direction that is perpendicular to a registration process flow. Each nip may act upon a sheet being registered. The magnitude of the velocity of a sheet at a nip is based in part on the nip loading force. Thus, a sheet angular velocity variation may be generated in response to loading force variations for one or more nips. A servo control feedback system may control the nip loading force via an actuator. Skew measurements may be obtained from a plurality of sheet edge sensors or encoders placed on the idler wheels. The servo control feedback system may reduce skew errors at the registration location.

The inboard and outboard drive wheels may have substantially identical angular velocities in systems which rotate each drive wheel using the same motor. However, the surface velocity of a sheet at each nip may differ for a variety of reasons. For example, the surface velocity at two nips may differ because of differences between the drive wheel or idler wheel diameters, the loading force for the idler wheel, sheet drag forces, the moments exerted and/or the like at each nip. A surface velocity difference between an inboard nip and an outboard nip may cause skew error to be caused or corrected as the sheet moves from the auxiliary sheet transport nips to the registration location.

Figure 2A:
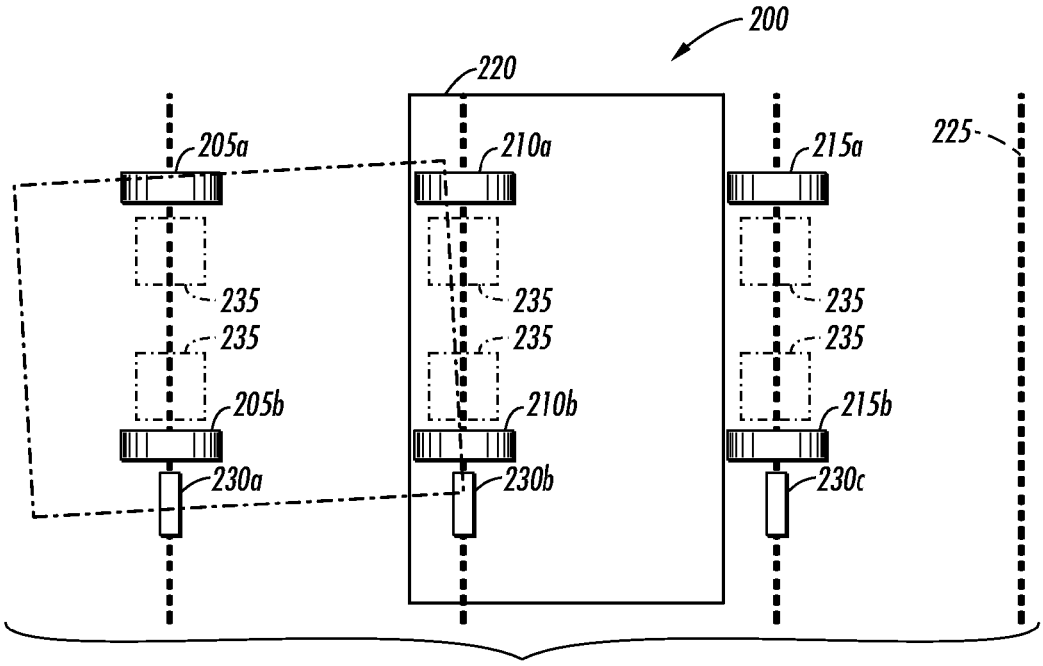
FIG. 2A depicts a top view of an exemplary document processing device and an exemplary sheet skew measurement system according to an embodiment.

FIG. 2A depicts a top view of a portion of an exemplary document processing device and an exemplary sheet skew measurement system according to an embodiment. As shown in FIG. 2A, the document processing device 200 may include three sets of nips: transport nips 205*a-b* that may be used to transport a sheet to a sheet registration system 220, registration nips 205*a-b* that may be used to perform sheet registration, and auxiliary sheet transport nips 215*a-b* that may be used to move the sheet in the process direction after registration. In an embodiment, the auxiliary sheet transport nips 215*a-b* may be used to perform fine skew adjustment as disclosed further herein.

Although each set of nips is shown as a nip pair, additional or fewer nips may be used. For example, additional nips may be used to account for variations in sheet size. In an embodiment, nips may be used for each of the transport, registration and auxiliary sheet transport functions for each of 11-inch wide and 14-inch wide sheets. In an embodiment, nips used to register narrow sheets (such as an 11-inch wide sheet) may be deactivated when registering a wide sheet (such as a 14-inch sheet), and vice versa.

The auxiliary sheet transport nips 215*a-b* may be located between the sheet registration system 220 and a registration location 225 (i.e., a location at which sheets need to be registered). The sheet registration system 220 may be configured to deliver a sheet to the auxiliary sheet transport nips 215*a-b* with no more than a specified amount of skew.

The document processing device 200 may include a plurality of sensors, such as 230*a-c*, which are used to determine the position and alignment of the sheet prior to, during or after registration. In an embodiment, the location of the sensors 230*a-c* may be substantially inline with the nip pairs. In an alternate embodiment, the sensors 230*a-c* may be placed in advance of or behind the nip pairs with respect to the process flow. More or fewer sensors may be used in the document processing device 200.

In an embodiment, one or more encoders 235 may be placed on one or more nips to assist with sheet registration. For example, an encoder 235 may be mounted on or adjacent to an idler wheel of a nip, such as 205*a-b*, 210*a-b* or 215*a-b*. The encoder 235 may provide an output signal to a controller. In an embodiment, the output signal may correspond to the rotational velocity of the idler wheel on which the encoder 235 is placed. Methods and systems for using sensors 230 and/or encoders 235 to assist with sheet registration are known to those of ordinary skill in the art.

Figure 2B:
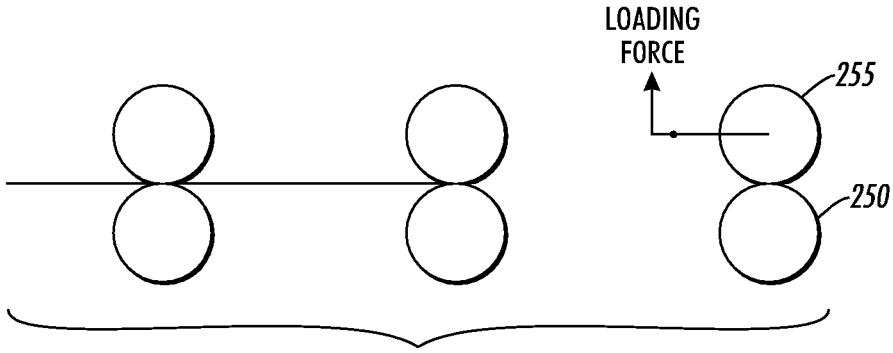
FIG. 2B depicts a side view of a portion of an exemplary document processing device according to an embodiment.

FIG. 2B depicts a side view of a portion of an exemplary document processing device according to an embodiment. As shown in FIG. 2B, a typical nip, such as 215*a*, includes a drive wheel, such as 250, and an idler wheel, such as 255. The drive wheel 250 may be a portion of a nip that is designed to propel a sheet. In an embodiment, the drive wheel 250 may comprise a compliant material. The drive wheel 250 may be directly driven using a motor or indirectly driven by using a gear train, belt transmission or the like.

The idler wheel 255 may be a portion of a nip that is designed to be loaded against the drive wheel 250 using a spring or other device. As such, the idler wheel 255 may produce a normal loading force that together with friction between a sheet and each of the drive wheel 250 and the idler wheel propels the sheet in a process direction. In an embodiment, the idler wheel 255 may comprise a non-compliant material. In an embodiment, an idler wheel 255, such as the idler wheel of at least one auxiliary sheet transport nip 215*a-b*, may be used to apply a variable loading force against the drive wheel 250. In an embodiment, an electromechanical actuator may be used to adjust the loading force applied by the idler wheel 255. Exemplary systems and methods for varying the loading force of one or more idler wheels 255 are described herein below.

Figure 3:
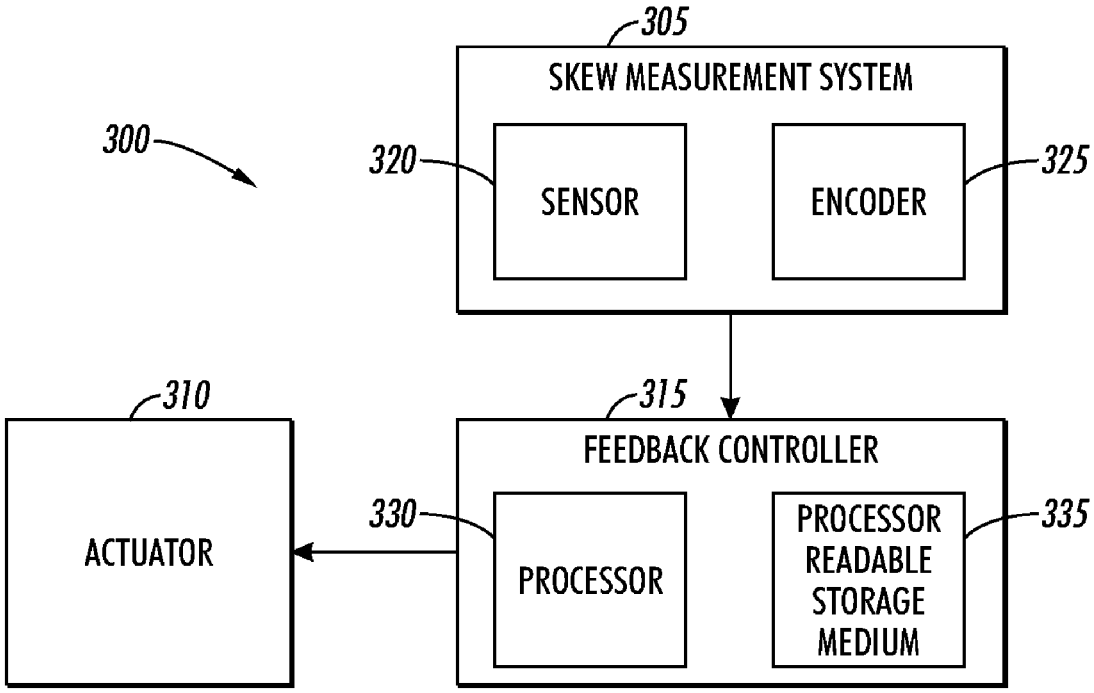
FIG. 3 depicts a block diagram for an exemplary skew adjustment feedback control system according to an embodiment.

FIG. 3 depicts a block diagram for an exemplary skew adjustment feedback control system according to an embodiment. A skew adjustment feedback control system 300 may be configured to adjust the skew of a sheet during transport to the registration location. The control system 300 may include a sheet skew measurement system 305, a sheet skew actuator 310 and a feedback controller 315. The sheet skew measurement system 305 may include one or more sensors 320 and/or one or more encoders 325. In an embodiment, a plurality of sensors 320 may be used to detect, for example, a sheet edge in a plurality of locations. The sensors 320 may determine the skew for a sheet by determining the location of the sheet in a non-process direction. The sheet location information may be transmitted from each sensor 320 to the feedback controller 315 for processing. In an alternate embodiment, the sheet skew measurement system 305 may include only a single edge sensor 320 that is used to observe skew measurements for a sheet over time, such as is described in U.S. Pat. No. 5,887,996 to Castelli et al. Any number of sensors 320 may be used within the scope of the present disclosure.

Additionally or alternately, skew measurements may be obtained from one or more encoders 325. For example, a rotary encoder 325 may be mounted on either side of an idler wheel and may provide output signals to the feedback controller 315 that directly identifies the rotation thereof in an otherwise known manner. The encoder 325 may be used to accurately and independently signal the rotary position of an idler wheel that is mating with nip normal force with a respective drive wheel. Because the idler wheel is not subject to any driving force, and is made of a non-compliant material, the idler wheel may not be deformed by nip forces or have any slip relative to the sheet. As such, the idler wheel may have a rotational velocity that directly corresponds to the actual surface velocity of the sheet. The rotational velocity information may be accurately recorded by the encoder 325 and transmitted to the feedback controller 315 for processing. An exemplary sheet skew measurement system 305 using encoders 325 is further described in U.S. Pat. No. 7,243,917 to Knierim et al.

A sheet skew actuator 310 may be used to change the loading force applied to a sheet by the idler wheels for one or more nips. As the sheet skew actuator 310 causes an associated idler wheel to increase the loading force that it applies to a sheet, the velocity of the sheet at the idler wheel may increase. Conversely, as the sheet skew actuator 310 causes the associated idler wheel to decrease the loading force that it applies to the sheet, the velocity of the sheet at the idler wheel may decrease. Exemplary sheet skew actuators 310 are described below in reference to FIGS. 5 and 6 and may be employed as part of the system described above in reference to FIGS. 2A and 2B. Alternate electromechanical sheet skew actuators 310 that produce adjustable nip loading forces may also be employed within the scope of the present disclosure.

In an embodiment, the sheet skew actuator 310 may be configured to adjust a first loading force applied to a sheet by an idler wheel for a first nip and a second loading force applied to the sheet by an idler wheel for a second nip with the same polarity. In other words, if the sheet skew actuator 310 is directed to increase the first loading force, the actuator will increase the second loading force as well. Similarly, if the sheet skew actuator 310 is directed to decrease the first loading force, the actuator will decrease the second loading force as well.

In an alternate embodiment the sheet skew actuator 310 may be configured to adjust a first loading force applied to a sheet by an idler wheel for a first nip and a second loading force applied to the sheet by an idler wheel for a second nip with a different polarity. As such, if the sheet skew actuator 310 is directed to increase the first loading force, the actuator will decrease the second loading force. Conversely, if the sheet skew actuator 310 is directed to decrease the first loading force, the actuator will increase the second loading force.

A feedback controller 315 may be used to process information received from the sheet skew measurement system 305 to direct the operation of the sheet skew actuator 310. For example, the feedback controller 315 may send one or more control signals to the sheet skew actuator 310 in response to information received from the sheet skew measurement system 305. The control signals may direct the sheet skew actuator 310 to adjust the skew of a sheet being registered by modifying the loading force of the one or more idler wheels controlled by the sheet skew actuator.

In an embodiment, the feedback controller 315 may include a processor 330 and a processor-readable storage medium 335, such as RAM, ROM and/or any other memory, a CD, DVD and/or any other storage device, In an embodiment, the processor-readable storage medium 335 may contain one or more programming instructions that, when executed by the processor 330, perform a method of reducing sheet skew.

Figure 4:
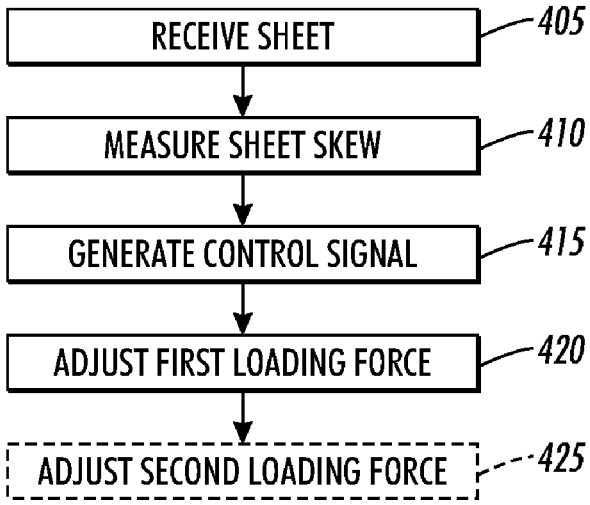
FIG. 4 depicts a flow diagram for an exemplary method of reducing sheet skew according to an embodiment.

FIG. 4 depicts a flow diagram of an exemplary method of reducing sheet skew according to an embodiment. As shown in FIG. 4, a sheet may be received 405 by a document processing device. The document processing device may include first and second nips. Each nip may include an idler wheel and a drive wheel. Each idler wheel may be configured to apply a loading force against the sheet as the sheet moves through the corresponding nip.

The sheet skew for the sheet may be measured 410. In an embodiment, the sheet skew may be measured using one or more sensors. In an embodiment, measurement of the sheet skew may include using an encoder associated with one or more of the nips, such as the second nip. In an embodiment, an encoder may be used to determine the angular velocity of the idler wheel for the associated nip.

A control signal may be generated 415 in response to the measured sheet skew. The control signal may contain information pertaining to the skew of the sheet and/or the velocity of the idler wheel for the nip associated with an encoder.

A first loading force for the idler wheel of the first nip may be adjusted 420 based on the control signal. For example, the first loading force may be increased 420 if it is desirable that the sheet velocity at the first nip be increased. Conversely, the loading force may be decreased 420 if it is desirable that the sheet velocity at the second nip be decreased.

In an embodiment, the method may further include adjusting 425 a second loading force for the idler wheel of the second nip based on the control signal. In an embodiment, the first loading force and the second loading force may be adjusted 420, 425 with the same polarity. In an alternate embodiment, the first loading force and the second loading force may be adjusted 420, 425 with differing polarities.

Figure 5:
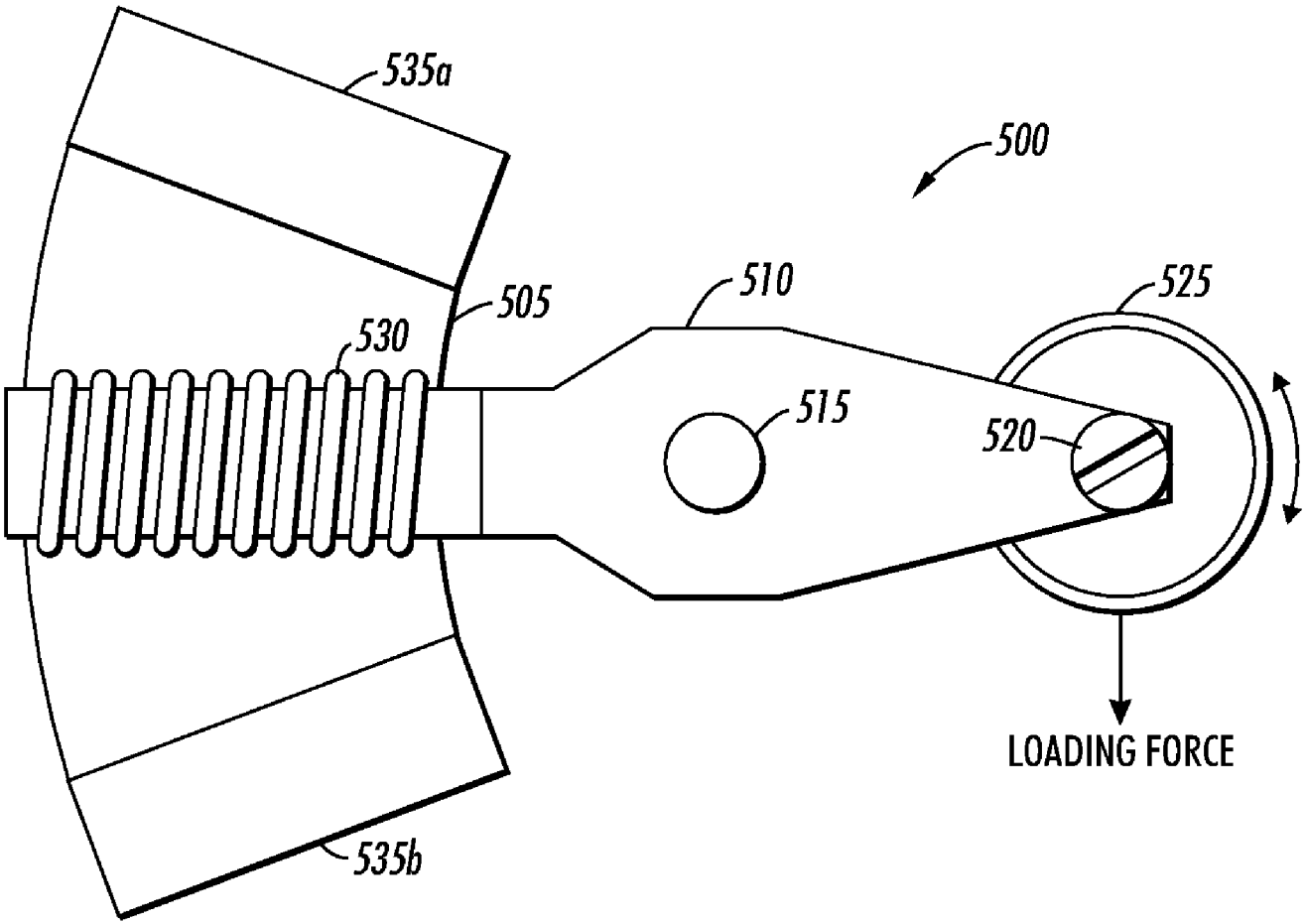
FIG. 5 depicts a lateral view of an exemplary electromechanical sheet skew actuator according to an embodiment.

FIG. 5 depicts a lateral view of an exemplary electromechanical sheet skew actuator according to an embodiment. As shown in FIG. 5, the exemplary sheet skew actuator 500 may include a linear solenoid 505, a body 510 and a pivot 515. The sheet skew actuator 500 may be removably attached to an idler wheel 525 for a nip via a fastener, such as screw 520.

The linear solenoid 505 may be, for example, a transducer device that converts energy into linear motion. The linear solenoid 505 may control the flow of electricity through a coil 530 located on the actuator body 510. In an embodiment, the coil 530 may act as an electromagnet by producing a magnetic field that interacts with magnetic fields of magnets located, for example, above 535*a* and below 535*b* the coil. The interaction of the magnetic fields may cause the actuator body 510 to move. In turn, the idler wheel 525 located on the opposite end of the actuator body 510 may move as well. In an embodiment, when the coil 530 moves downward, the actuator body 510 may pivot around the pivot 515 to move the idler wheel 525 upward, which may reduce the loading force of the idler wheel. Conversely, when the coil 530 moves upward, the actuator body 510 may pivot around the pivot 515 to move the idler wheel 525 downward, which may increase the loading force of the idler wheel 525. In an embodiment, a sheet skew actuator 500 may be used to control the loading force for an idler wheel corresponding to a nip. In an embodiment, a sheet skew actuator 500 may be used to increase or decrease the loading forces for a plurality of idler wheels 525 associated with a plurality of nips simultaneously.

Figure 6:
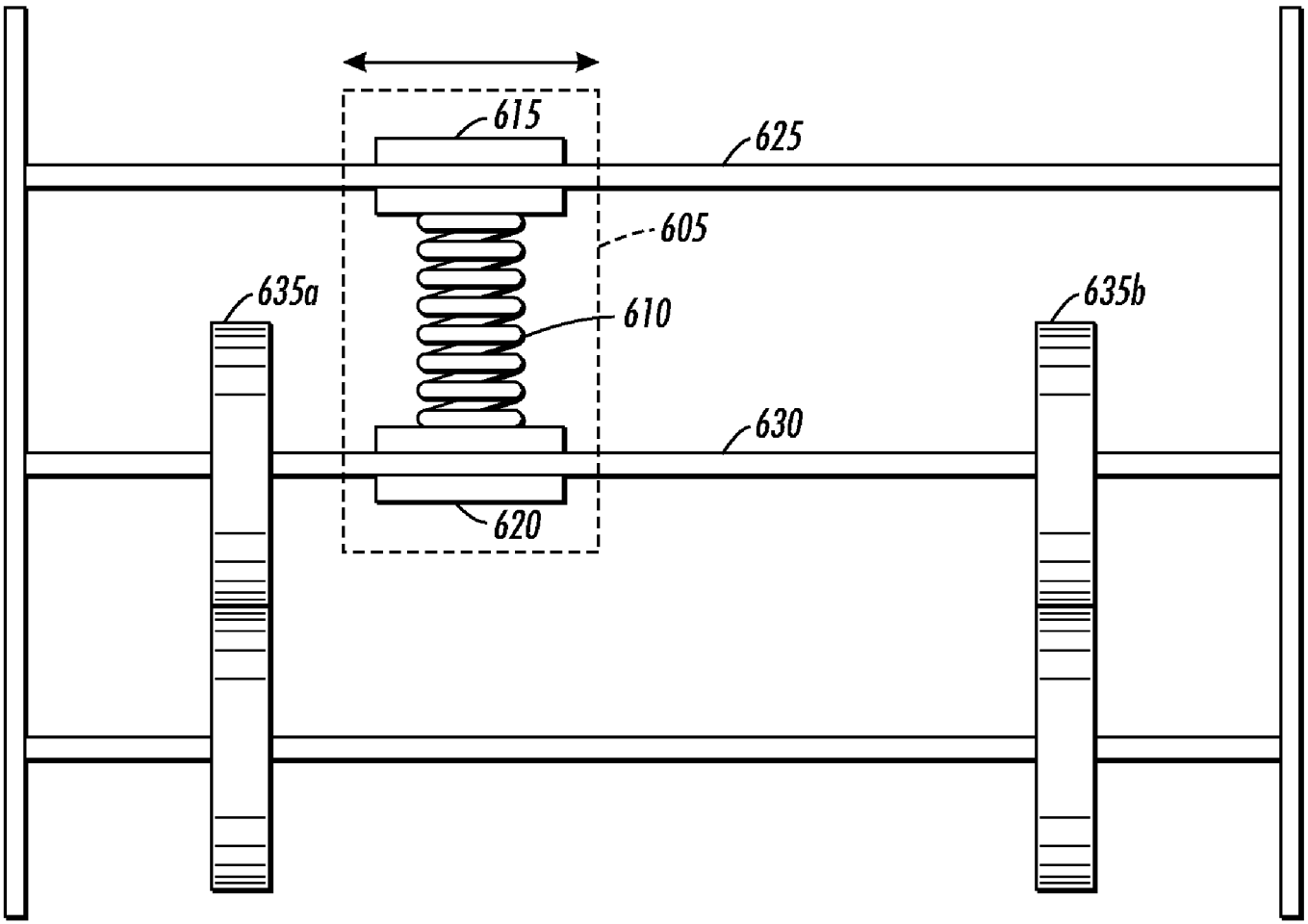
FIG. 6 depicts a side view of an alternate exemplary electromechanical sheet skew actuator and corresponding nip pair according to an embodiment.

FIG. 6 depicts a side view of an alternate exemplary electromechanical sheet skew actuator and corresponding nip pair according to an embodiment. As shown in FIG. 6, the exemplary sheet skew actuator 605 may include a spring 610 and may have a first interface 615 and a second interface 620. The spring 610 may be used to apply a uniform force between the first interface 615 and the second interface 620. The first interface 615 may engage a first axle 625, and the second interface 620 may engage a second axle 630. In an embodiment, the first axle 625 may be in a fixed position with respect to a sheet registration process location. In contrast, the second axle 630 may be adjustably positioned based on the lateral position of the actuator 605 with respect to the idler wheels for the nip pair 635*a-b*. As shown in FIG. 6, the idler wheels for the nip pair 635*a-b* may revolve around the second axle 630.

The sheet skew actuator 605 may move laterally along the first and second axles 625, 630. In an embodiment, if the sheet skew actuator 605 is located at a position equidistant from the first nip and the second nip, the force applied by the spring 610 may cause the second axle 630 to be substantially parallel to the first axle 625. As such, the force applied by the spring 610 may cause the idler wheel of the first nip 635*a* and the idler wheel of the second nip 635*b* to apply substantially equal loading forces to a sheet being registered. If the sheet skew actuator 605 is positioned closer to the first nip 635*a* than the second nip 635*b* (as is shown in FIG. 6), the force applied by the spring 610 may cause the second axle 630 to tilt such that the loading force of the idler wheel of the first nip is greater than the loading force of the idler wheel of the second nip. In contrast, if the sheet skew actuator 605 is positioned farther from the first nip 635*a* than the second nip 635*b*, the force applied by the spring 610 may cause the second axle 630 to tilt such that the loading force of the idler wheel of the first nip is less than the loading force of the idler wheel of the second nip, As such, the differential loading force (i.e., the difference between the loading force of the idler wheel of the first nip 635*a* and the loading force of the idler wheel of the second nip 635*b*) may be used to adjust the skew of a sheet being registered.

EXAMPLE

Figure 7A:
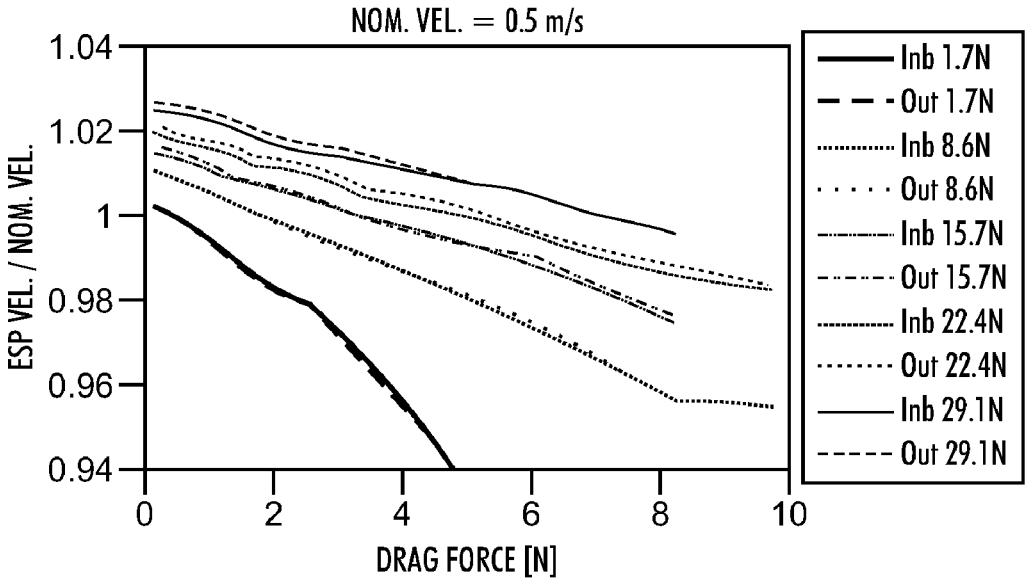
FIGS. 7A and 7B depict graphs of a process velocity change at a nip as a function of the idler wheel load for different drag forces and nominal velocities.
Figure 7B:
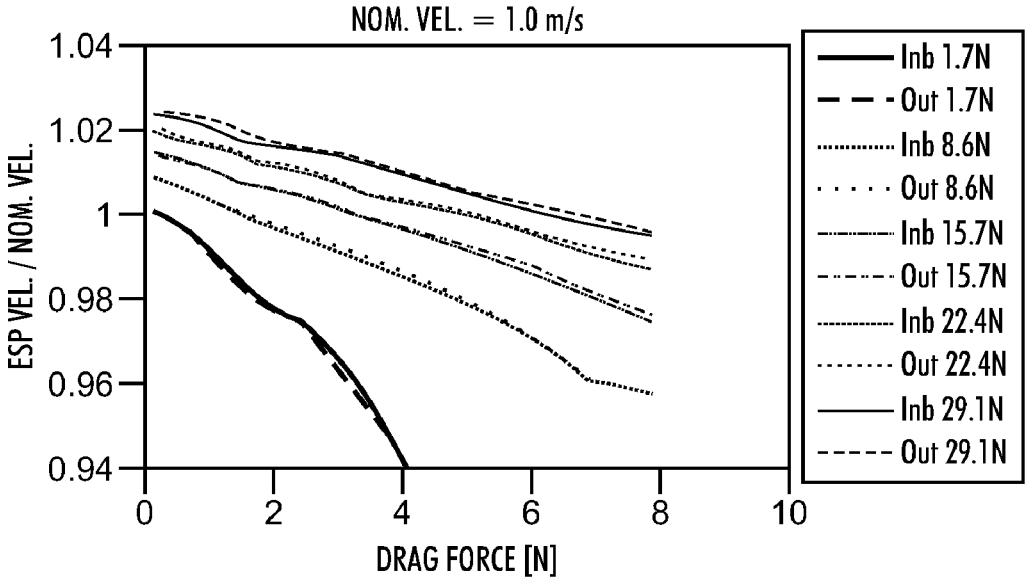

FIGS. 7A and 7B depict graphs of the process velocity variation of a sheet at a nip as a function of the drag force of the sheet for a plurality of idler wheel loading forces. A "drag force" is a force exerted by a sheet on a nip. The loading force for an idler wheel was varied from, for example, 1.7 N to 29.1 N. The velocity of a sheet at the nip was then measured. FIG. 7A represents the percentage variation for the sheet velocity at a nip for sheets being processed at a nominal velocity of 0.5 meters per second. FIG. 7B represents the percentage variation for the sheet velocity at a nip for sheets being processed at a nominal velocity of 1.0 meters per second.

As shown in FIG. 7A, the measured velocity at a nominal drag force of 2 N changes from about −2% (0.98) to about +2% (1.02) for a nip load variation of about 1.7 N to about 29.1 N. Likewise, the measured velocity at a nominal drag force of 4 N changes from about −4% (0.96) to about +1% (1.01) for the same nip load variation. As such, the process velocity variation percentage as a function of nip loading force is about 0.15%/N to about 0.18%/N or about 0.66%/lbf to about 0.83%/lbf for typical nominal drag forces at a nominal process velocity of 0.5 m/s.

As shown in FIG. 7B the measured velocity at a nominal drag force of 2 N changes from about −2% (10.98) to about +2% (1.02) for a nip load variation of about 1.7 N to about 29.1 N. Likewise, the measured velocity at a nominal drag force of 4 N changes from about −6% (0.94) to about +1%

(1.01) for the same nip load variation. As such, the process velocity variation percentage as a function of nip loading force is about 0.15%/N to about 0.26%/N or about 0.66%/lbf to about 1.16%/lbf for typical nominal drag forces at a nominal process velocity of 1.0 m/s.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A document processing device, comprising:

a first nip comprising a first idler wheel and a first drive wheel;

one or more second nips, wherein each second nip comprises a second idler wheel and a second drive wheel;

a sheet skew measurement system for measuring sheet skew for a sheet;

a feedback controller for generating a control signal in response to sheet skew measured by the sheet skew measurement system; and an actuator for adjusting a loading force applied to a sheet by the first idler wheel for the first nip in response to the control signal, wherein the loading force applied to the sheet by the first idler wheel is adjusted and is greater than zero when the sheet is nipped in the first nip.

2. The document processing device of claim 1 wherein the sheet skew measurement system comprises a sensor for detecting an edge of a sheet.

3. The document processing device of claim 1 wherein the sheet skew measurement system comprises an encoder for detecting an angular velocity for the first idler wheel of the first nip.

4. The document processing device of claim 1 wherein the actuator is configured to adjust a first loading force applied to a sheet by an idler wheel for a first nip and a second loading force applied to the sheet by an idler wheel for a second nip with a same polarity.

5. The document processing device of claim 1 wherein the actuator is configured to adjust a first loading force applied to a sheet by an idler wheel for a first nip and a second loading force applied to the sheet by an idler wheel for a second nip with a different polarity.

6. The document processing device of claim 1 wherein the actuator comprises an actuator for adjusting the loading force applied by the first idler wheel for the first nip in response to the control signal in real time.

7. A document processing device, comprising:

a plurality of nips comprising a first nip and other nips, wherein each nip of the plurality of nips comprises an idler wheel and a drive wheel;

a sheet skew measurement system for measuring sheet skew for a sheet;

a feedback controller for generating a control signal in response to sheet skew measured by the sheet skew measurement system; and an actuator for adjusting a loading force applied to a sheet by the idler wheel for the first nip in response to the control signal, wherein the loading force applied to the sheet by the idler wheel for the first nip is adjusted and is greater than zero when the sheet is nipped in the first nip.

8. The document processing device of claim 7 wherein the sheet skew measurement system comprises a sensor for detecting an edge of a sheet.

9. The document processing device of claim 7 wherein the sheet skew measurement system comprises an encoder for detecting an angular velocity for the idler wheel of the first nip.

10. The document processing device of claim 7 wherein the actuator comprises an actuator for adjusting the loading force applied by the idler wheel for the first nip in response to the control signal in real time.

* * * * *